US010850509B2

(12) United States Patent
Anderson et al.

(10) Patent No.: US 10,850,509 B2
(45) Date of Patent: Dec. 1, 2020

(54) ON-DIE ACTUATOR EVALUATION WITH PRE-CHARGED THRESHOLDS

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/472,960

(22) PCT Filed: Apr. 5, 2017

(86) PCT No.: PCT/US2017/026144
§ 371 (c)(1),
(2) Date: Jun. 24, 2019

(87) PCT Pub. No.: WO2018/186853
PCT Pub. Date: Oct. 11, 2018

(65) Prior Publication Data

US 2020/0180304 A1 Jun. 11, 2020

(51) Int. Cl.
*B41J 2/045* (2006.01)
*B41J 2/14* (2006.01)

(52) U.S. Cl.
CPC ..... *B41J 2/0458* (2013.01); *B41J 2/04541* (2013.01); *B41J 2/0451* (2013.01); (Continued)

(58) Field of Classification Search
CPC ..... B41J 2/0458; B41J 2/04541; B41J 2/14; B41J 2202/12; B41J 2/04543; B41J 2/04573; B41J 2/0451
See application file for complete search history.

(56) References Cited

U.S. PATENT DOCUMENTS 9,399,342 B2 7/2016 Marchant
9,452,604 B2 9/2016 Van Brocklin et al.
(Continued)

FOREIGN PATENT DOCUMENTS

WO WO-2015116072 A1 8/2015
WO WO-2015167561 A1 11/2015
(Continued)

OTHER PUBLICATIONS

IP.com search (Year: 2020).*
(Continued)

*Primary Examiner* — Lisa Solomon
(74) *Attorney, Agent, or Firm* — Fabian VanCott

(57) ABSTRACT

A fluid ejection die includes a number of actuator sensors to sense a characteristic of a corresponding actuator and to output a first voltage corresponding to the sensed characteristic. Multiple coupled actuator sensors and actuators are grouped as primitives on the fluid ejection die. The die also includes a pre-charge device per primitive to pre-charge a corresponding threshold voltage storage device to a threshold voltage. The die also includes an actuator evaluation die per primitive to evaluate an actuator characteristic of any actuator within the primitive.

15 Claims, 7 Drawing Sheets

(52) U.S. Cl.
CPC ..... *B41J 2/04543* (2013.01); *B41J 2/04573* (2013.01); *B41J 2/14* (2013.01); *B41J 2202/12* (2013.01)

(56) References Cited

U.S. PATENT DOCUMENTS

| | | | |
|---|---|---|---|
| 9,457,560 | B2 | 10/2016 | Ready et al. |
| 9,493,002 | B2 | 11/2016 | Edelen et al. |
| 2013/0278656 | A1 | 10/2013 | Govyadinov |
| 2014/0292891 | A1 | 10/2014 | Ike |
| 2017/0021626 | A1 | 1/2017 | Ge et al. |
| 2017/0028738 | A1 | 2/2017 | Ghozeil et al. |

FOREIGN PATENT DOCUMENTS

| | | | | |
|---|---|---|---|---|
| WO | WO-16066728 | | 5/2016 | |
| WO | WO-16175740 | | 11/2016 | |
| WO | WO-2018186862 | A1 * | 10/2018 | ..... B41J 2/0458 |

OTHER PUBLICATIONS

"HP Pagewide Technology" <http://www8.hp.com/ie/en/pdf/HP_PageWide_Technology_Whitepaper_tcm_147_1373163.pdf > Dec. 2012.

* cited by examiner

ON-DIE ACTUATOR EVALUATION WITH PRE-CHARGED THRESHOLDS

BACKGROUND

A fluid ejection die is a component of a fluid ejection system that includes a number of nozzles. The dies can also include other actuators such as micro-recirculation pumps. Through these nozzles and pumps, fluid, such as ink and fusing agent among others, is ejected or moved. Over time, these nozzles and actuators can become clogged or otherwise inoperable. As a specific example, over time, ink in a printing device can harden and crust, thereby blocking the nozzle and interrupting the operation of subsequent ejection events. Other examples of issues affecting these actuators include fluid fusing on an ejecting element, particle contamination, surface puddling and surface damage to die structures. These and other scenarios may adversely affect operations of the device in which the die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
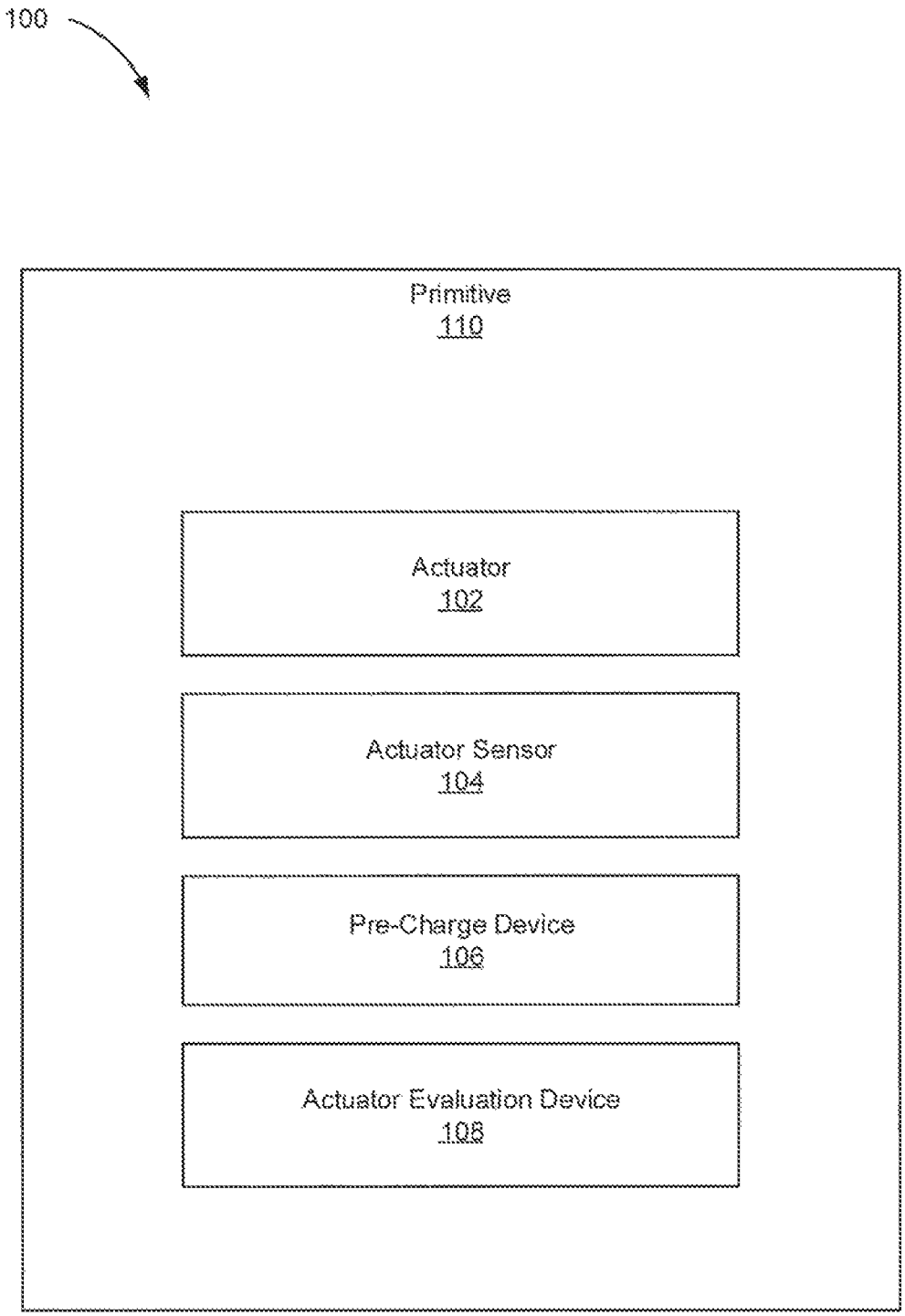
FIGS. 1A and 1B are block diagrams of a fluid ejection die including on-die actuator evaluation components using a pre-charged threshold voltage, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

A fluid ejection die is a component of a fluid ejection system that includes a number of actuators. These actuators may come in the form of nozzles that eject fluid from a die, or non-ejecting actuators, such as recirculation pumps that circulate fluid throughout the fluid channels on the die. Through these nozzles and pumps, fluid, such as ink and fusing agent among others, is ejected or moved.

Specific examples of devices that rely on fluid ejection systems include, but are not limited to, inkjet printers, multi-function printers (MFPs), and additive manufacturing apparatuses. The fluid ejection systems in these systems are widely used for precisely, and rapidly, dispensing small quantities of fluid. For example, in an additive manufacturing apparatus, the fluid ejection system dispenses fusing agents. The fusing agent is deposited on a build material, which fusing agent facilitates the hardening of build material to form a three-dimensional product.

Other fluid ejection systems dispense ink on a two-dimensional print medium such as paper. For example, during inkjet printing, ink is directed to a fluid ejection die. Depending on the content to be printed, the device in which the fluid ejection system is disposed, determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing operation, i.e., depositing fluid on a substrate, and in a three-dimensional printing, i.e., depositing a fusing agent on a material base to form a three-dimensional printed product.

To eject the fluid, these fluid ejection dies include nozzles and other actuators. Fluid is ejected from the die via nozzles and is moved throughout the die via other actuators, such as pumps. The fluid ejected through each nozzle comes from a corresponding fluid reservoir in fluid communication with the nozzle.

To eject the fluid, each nozzle includes various components. For example, a nozzle includes an ejector, an ejection chamber, and a nozzle orifice. An ejection chamber of the nozzle holds an amount of fluid. An ejector in the ejection chamber operates to eject fluid out of the ejection chamber, through the nozzle orifice. The ejector may include a thermal resistor or other thermal device, a piezoelectric element, or other mechanism for ejecting fluid from the firing chamber.

While such fluid ejection systems and dies undoubtedly have advanced the field of precise fluid delivery, some conditions impact their effectiveness. For example, the nozzles on a die are subject to many cycles of heating, drive bubble formation, drive bubble collapse, and fluid replenishment from a fluid reservoir. Over time, and depending on other operating conditions, the nozzles may become blocked or otherwise defective. For example, particulate matter, such as dried ink or powder build material, can block the nozzle. This particulate matter can adversely affect the formation and release of subsequent printing fluid. Other examples of scenarios that may impact the operation of a printing device include a fusing of the printing fluid on the ejector element, surface puddling, and general damage to components within the nozzle. As the process of depositing fluid on a surface is a precise operation, these blockages can have a deleterious effect on print quality. If one of these actuators fails, and is continually operated following failure, then it may cause neighboring actuators to fail.

Accordingly, the present specification describes a method to determine whether a particular actuator has failed. Specifically, the present specification describes a die that includes on-die components that 1) evaluate whether an actuator is operating as expected. In doing so, the on-die components compare an output voltage that is indicative of a condition of the actuator against a threshold voltage. However, the transmission line along which the threshold voltage is transmitted may be near other transmission lines such as lines that pass activation signals or supply power to the other actuators. These other transmission lines introduce noise into the threshold transmission line. This noise can obfuscate the threshold voltage and make any comparison of the sense voltage with the threshold voltage less accurate.

Accordingly, the present method and systems describe pre-charging the threshold voltage during an electrically quiescent time period when there is little to no actuator activation or data clocking among other noise sources. By so doing, the noise effects on a threshold voltage may be reduced making any evaluation of an actuator more reliable and easier to execute.

Specifically, the present specification describes a fluid ejection die. The fluid ejection die includes a number of actuator sensors disposed on the fluid ejection die to sense a characteristic of a corresponding actuator and to output a first voltage corresponding to the sensed characteristic. Each actuator sensor is coupled to a respective actuator and multiple coupled actuator sensors and actuators are grouped as primitives on the fluid ejection die. The fluid ejection die also includes a pre-charge device per primitive to pre-charge a corresponding threshold voltage storage device to a threshold voltage. The fluid ejection die also includes an actuator evaluation device per primitive to evaluate an actuator characteristic of any actuator within the primitive based on the first voltage and a pre-charged threshold voltage.

The present specification also describes a fluid ejection system that includes multiple fluid ejection dies. A fluid ejection die includes a number of drive bubble detection devices to output a first voltage indicative of a state of a corresponding actuator. Each drive bubble detection device is coupled to a respective actuator of the number of the actuators and multiple coupled drive bubble detection devices and actuators are grouped as primitives on the fluid ejection die. Each die also includes a pre-charge device per primitive to pre-charge a corresponding threshold storage device to a threshold voltage. Each die also includes an actuator evaluation device per primitive to evaluate an actuator characteristic of the actuator based at least in part on a comparison of the first voltage and a pre-charged threshold voltage.

The present specification also describes a method for evaluating actuator characteristics on a fluid ejection die. According to the method, a threshold voltage storage device is selectively pre-charged to a threshold voltage. An activation pulse for an actuator of a primitive is received and the actuator is activated based on the activation pulse. The activation event generates a first voltage output by a corresponding actuator sensor. The corresponding actuator sensor is also disposed on the fluid ejection die and is coupled to the actuator. An actuator characteristic is then evaluated based at least in part on a comparison of the first voltage and a pre-charged threshold voltage.

In this example, the actuator sensor, actuator, pre-charge device, and evaluation components are disposed on the fluid ejection die itself as opposed to being off die, for example as a part of printer circuitry or other fluid ejection system circuitry. When such actuator evaluation circuitry is not on the fluid ejection die, gathered information from an actuator sensor is passed off die where it is used to determine a state of the corresponding actuator. Accordingly, by incorporating these elements directly on the fluid ejection die, increased technical functionality of a fluid ejection die is enabled. For example, printer-die communication bandwidth usage are reduced when sensor information is not passed off-die, but is rather maintained on the fluid ejection die when evaluating an actuator. On-die circuitry also reduces the computational overhead of the printer in which the fluid ejection die is disposed. Still further, having such actuator evaluation circuitry on the fluid ejection die itself removes the printer from managing actuator service and/or repair and localizes it to the die itself. Additionally, by not locating such sensing and evaluation circuitry off-die, but maintaining it on the fluid ejection die, there can be faster responses to malfunctioning actuators. Still further, positioning this circuitry on the fluid ejection die reduces the sensitivity of these components to electrical noise that could corrupt the signals if they were driven off the fluid ejection die.

In summary, using such a fluid ejection die 1) allows for nozzle evaluation circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning nozzles; 5) allows for actuator evaluation in one primitive while allowing continued operation of actuators in another primitive; 6) places management of nozzles on the fluid ejection die as opposed to on the printer in which the fluid ejection die is installed; and 7) improves the accuracy of actuator evaluation by accounting for the effects of noise on the signals. However, it is contemplated that the devices disclosed herein may address other matters and deficiencies in a number of technical areas.

As used in the present specification and in the appended claims, the term "actuator" refers to a nozzle or another non-ejecting actuator. For example, a nozzle, which is an actuator, operates to eject fluid from the fluid ejection die. A recirculation pump, which is an example of a non-ejecting actuator, moves fluid throughout the fluid slots, channels, and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a shared nozzle orifice.

Further, as used in the present specification and in the appended claims, the term "fluid ejection die" refers to a component of a fluid ejection device that includes a number of nozzles through which a printing fluid is ejected. Groups of actuators are categorized as "primitives" of the fluid ejection die. In one example, a primitive may include between 8-16 actuators. However, a primitive can include any integer number of actuators. In one example, the fluid ejection die may be organized first into two columns with 30-150 primitives per column. However, the primitives of a fluid ejection die can be grouped into any number of columns.

Still further, as used in the present specification and in the appended claims, the term "electrical quiescent" refers to a period of time when the device in which the fluid ejection die is disposed has little electrical activity. It may be a short period of time, for example in between printing swaths or in between individual firing events when there is no actuator activation. Other examples include periods between pages of a print job, periods between print jobs, and outside of standard operating hours, for example at night. In some examples, the electrical quiescent period can last several microseconds or several nanoseconds.

Even further, as used in the present specification and in the appended claims, the term "a number of" or similar language is meant to be understood broadly as any positive number including 1 to infinity.

FIGS. 1A and 18 are block diagrams of a fluid ejection die (100) including on-die actuator evaluation components using a pre-charged threshold voltage, according to an example of the principles described herein. As described above, the fluid ejection die (100) is a component of a fluid ejection system that houses components for ejecting fluid and/or transporting fluid along various pathways. The fluid that is ejected and moved throughout the fluid ejection die (100) can be of various types including ink, biochemical agents, and/or fusing agents.

Figure 1B:
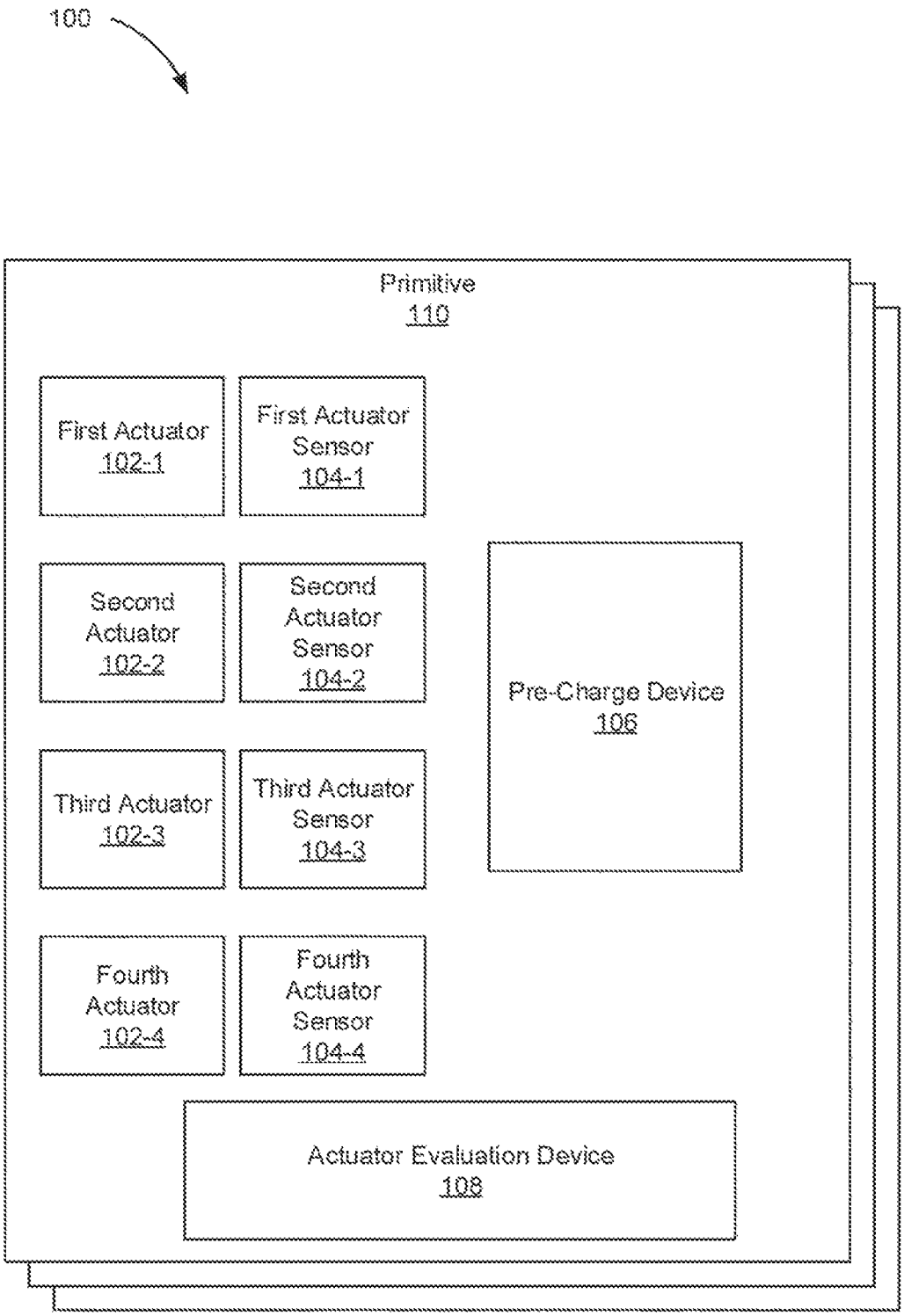

FIG. 1A depicts a fluid ejection die (100) with an actuator (102), an actuator sensor (104), a pre-charge device (106), and an actuator evaluation device (108) disposed on a primitive (110). FIG. 1B depicts a fluid ejection die (100) with multiple actuators (102), multiple actuator sensors (104), a pre-charge device (106), and an actuator evaluation device (108) disposed on each primitive (110).

The fluid ejection die (100) includes various actuators (102) to eject fluid from the fluid ejection die (100) or to otherwise move fluid throughout the fluid ejection die (100). In some cases there may be one actuator (102) as depicted in FIG. 1A, in other examples there may be multiple actuators (102-1, 102-2, 102-3, 102-4) as depicted in FIG. 1B. The actuators (102) may be of varying types. For example, nozzles are one type of actuator (102) that operates to eject fluid from the fluid ejection die (100). Another type of actuator (102) is a recirculation pump that moves fluid between a nozzle channel and a fluid slot that feeds the nozzle channel. While the present specification may make reference to a particular type of actuator (102), the fluid ejection die (100) may include any number and type of actuators (102). Also, within the figures the indication "-*" refers to a specific instance of a component. For example, a first actuator is identified as (102-1). By comparison, the absence of an indication "-*" refers to the component in general. For example, an actuator in general is referred to as an actuator (102).

Returning to the actuators (102). A nozzle is a type of actuator that ejects fluid originating in a fluid reservoir onto a surface such as paper or a build material volume. Specifically, the fluid ejected by the nozzles may be provided to the nozzle via a fluid feed slot, or an ink feed hole array, in the fluid ejection die (100) that fluidically couples the nozzles to a fluid reservoir. In order to eject the fluid, each nozzle includes a number of components, including an ejector, an ejection chamber, and a nozzle orifice. An example of an ejector, ejection chamber, and a nozzle orifice are provided below in connection with FIG. 2B.

The fluid ejection die (100) also includes actuator sensors (104) disposed on the fluid ejection die (100). In some cases there may be one actuator sensor (104) as depicted in FIG. 1A, in other examples there may be multiple actuator sensors (104-1, 104-2, 104-3, 104-4) as depicted in FIG. 1B. The actuator sensors (104) sense a characteristic of a corresponding actuator. For example, the actuator sensors (104) may be used to measure an impedance near an actuator (102). As a specific example, the actuator sensors (104) may be drive bubble detectors that enable the detection of the presence of a drive bubble within an ejection chamber of a nozzle.

A drive bubble is generated by an ejector element to move fluid in the ejection chamber. Specifically, in thermal inkjet printing, a thermal ejector heats up to vaporize a portion of fluid in an ejection chamber. As the bubble expands, it forces fluid out of the nozzle orifice and also towards the ink feed slot. As the bubble collapses, a negative pressure within the ejection chamber draws fluid from the fluid feed slot of the fluid ejection die (100). Sensing the proper formation and collapse of such a drive bubble can be used to evaluate whether a particular nozzle is operating as expected. That is, a blockage in the nozzle will affect the formation of the drive bubble. If a drive bubble has not formed as expected, it can be determined that the nozzle is blocked and/or not working in the intended manner.

The presence of a drive bubble can be detected by measuring impedance values within the ejection chamber at different points in time. That is, as the vapor that makes up the drive bubble has a different conductivity than the fluid that otherwise is disposed within the chamber, when a drive bubble exists in the ejection chamber, a different impedance value will be measured. Accordingly, a drive bubble detection sensor is used to measure this impedance and output a corresponding voltage. As will be described below, this output can be used to determine whether a drive bubble is properly forming and therefore determining whether the corresponding nozzle or pump is in a functioning or malfunctioning state. This output can be used to trigger subsequent actuator (102) management operations. While description has been provided of an impedance measurement, other characteristics may be measured to determine the characteristic of the corresponding actuator (102).

As described above, in some examples such as that depicted in FIG. 1B, each actuator sensor (104) of the number of actuator sensors (104) may be coupled to a respective actuator (102) of the number of actuators (102). In one example, each actuator sensor (104) is uniquely paired with the respective actuator (102). For example, a first actuator (102-1) may be uniquely paired with a first actuator sensor (104-1). Similarly, the second actuator (102-2), third actuator (102-3), and fourth actuator (102-4) may be uniquely paired with the second actuator sensor (104-2), third actuator sensor (104-3), and fourth actuator sensor (104-4). Multiple pairings of actuators (102) and actuator sensors (104) may be grouped together in a primitive (110) of the fluid ejection die (100). That is the fluid ejection die (100) may include any number of actuator (102)/actuator sensor (104) pairs grouped as primitives (110). Pairing the actuators (102) and actuator sensors (104) in this fashion increases the efficiency of actuator (102) management. While FIG. 1B depicts multiple actuators (102) and actuator sensors (104), a primitive (110) may have any number of actuator (102)/actuator sensor (104) pairs, including one, as depicted in FIG. 1A.

Including the actuator sensors (104) on the fluid ejection die (100), as opposed to some off die location such as on the printer, also increases efficiency. Specifically, it allows for sensing to occur locally, rather than off-die, which increases the speed with which sensing can occur.

The fluid ejection (100) also includes a pre-charge device (106) per primitive to pre-charge a corresponding threshold voltage storage device to a threshold voltage. In use, the transmission line on which the threshold voltage is passed to an actuator evaluation device (108) may run parallel to other transmission lines such as transmission lines that pass activation signals to nozzles and other actuators. Accordingly, many amps of current are turned on and off every few microseconds along those parallel lines. The coupling between these lines generates noise on the order of volts on the threshold voltage transmission line. As the threshold voltage is rather sensitive, a swing of a half volt in either direction could have an impact on the reliability of any measurement based on this threshold voltage. Accordingly, it is desirable to have a signal isolated from these noise signals.

The pre-charge device provides such isolation. Specifically, the pre-charge device (106) pre-charges a threshold voltage storage device during a period of time when there is little electrical interference. Such a period of time is referred to as an electrically quiescent period, which may be last several microseconds or several nanoseconds. Examples of quiescent periods include at an end of a swatch of a fluid ejection die, when it is turning around, between pages of a print job when there is no printing, between print jobs, and/or time periods when the device in which the fluid ejection die is entirely inactive, such as after business hours. During this electrically quiescent period, the pre-charge device (106) pre-loads a storage device to the threshold voltage. Accordingly, during a subsequent activation of an actuator (102), this pre-charged threshold voltage, which is free of noise, can be used to evaluate a condition of the particular actuator (102) under test.

The fluid ejection die (100) also includes an actuator evaluation device (108) per primitive (110). The actuator evaluation device (108) evaluates an actuator (102) based at least on an output of the actuator sensor (104). For example, a first actuator sensor (104-1) may output a voltage that corresponds to an impedance measurement within an ejection chamber of a first nozzle. This voltage may be compared against a threshold voltage, which threshold voltage delineates between an expected voltage with fluid present and an expected voltage with air present in the ejection chamber.

As a specific example, a voltage lower than the threshold voltage may indicate that fluid is present, which fluid has a lower impedance than fluid vapor. Accordingly, a voltage higher than the threshold voltage may indicate that vapor is present, which vapor has a higher impedance than fluid. Accordingly, at a time when a drive bubble is expected, a voltage output from an actuator sensor (104) that is higher than, or equal to, the threshold voltage would suggest the presence of a drive bubble while a voltage output from an actuator sensor (104) that is lower than the threshold voltage would suggest the lack of a drive bubble. In this case, as a drive bubble is expected, but the first voltage does not suggest such a drive bubble current is forming, it can be determined that the nozzle under test has a malfunctioning characteristic. While a specific relationship, i.e., low voltage indicates fluid, high voltage indicates air, has been described, any desired relationship can be implemented in accordance with the principles described herein.

In some examples, to properly determine whether an actuator (102) is functioning as expected, the corresponding actuator sensor (104) may take multiple measurements relating to the corresponding actuator (102), and the actuator evaluation device (108) may evaluate multiple measurement values before outputting an indication of the state of the actuator (102). The different measured values may be taken at different time intervals following a firing event. Accordingly, the different measured values are compared against different threshold voltages. Specifically, the impedance measurements that indicate a properly forming drive bubble are a function of time. For example, a drive bubble at its largest yields a highest impedance, then as the bubble collapses over time, the impedance measure drops, due to the reduced amount of air in the ejection chamber while it refills with fluid. Accordingly, the threshold voltage that indicates a properly forming drive bubble also changes over time. Comparing multiple voltage values against multiple threshold voltages following a firing event provides greater confidence in a determined state of a particular actuator (102).

As can be seen in FIGS. 1A and 1B, the actuator evaluation device (108) and pre-charge device (106) are per primitive (110). That is a single actuator evaluation device (108) and a single pre-charge device (106) interface with, and are uniquely paired with, just those actuators (102) and just those actuator sensors (104) of that particular primitive (110).

Figure 2A:
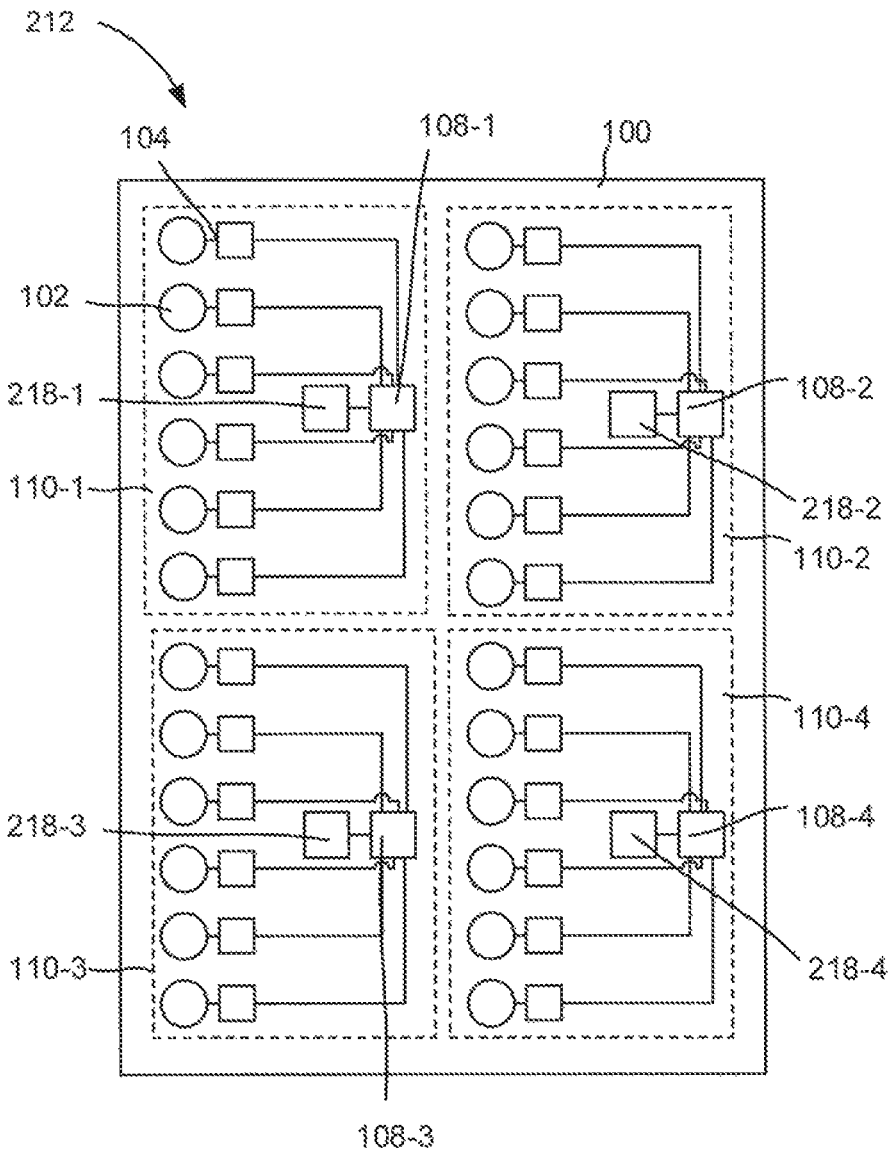
FIG. 2A is a block diagram of a fluid ejection system including on-die actuator evaluation components using a pre-charged threshold voltage, according to an example of the principles described herein.

FIG. 2A is a block diagram of a fluid ejection system (212) including on-die actuator evaluation components using a pre-charged threshold voltage, according to an example of the principles described herein. The system (212) includes a fluid ejection die (100) on which multiple actuators (102) and corresponding actuator sensors (104) are disposed. For simplicity, a single instance of an actuator (102), an actuator sensor (104) are indicated with reference numbers. However, a fluid ejection die (100) may include any number of actuators (102) and actuator sensors (104). In the example depicted in FIG. 2A, the actuators (102) and actuator sensors (104) are arranged into columns. The actuators (102) and actuator sensors (104), along with their corresponding pre-charge devices (218) and actuator evaluation devices (108) may be grouped into primitives (110-1, 110-2, 110-3, 110-4). In the case of actuators (102) that are fluid ejection nozzles, one nozzle per primitive (110) Is activated at a time. While FIG. 2A depicts six components per primitive (110), primitives (110) may have any number of these components.

Figure 2B:
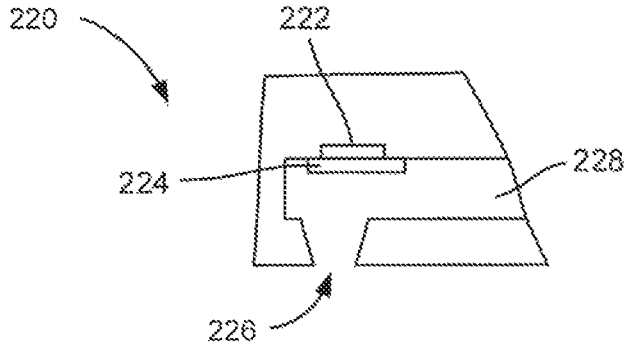
FIG. 2B is a cross-sectional diagram of a nozzle of the fluid ejection system depicted in FIG. 2A, according to an example of the principles described herein.

FIG. 2B is a cross-sectional diagram of a nozzle (220) of the fluid ejection system (212) depicted in FIG. 2A, according to an example of the principles described herein. As described above, a nozzle (220) is an actuator (102) that operates to eject fluid from the fluid ejection die (100) which fluid is initially disposed in a fluid reservoir that is fluidically coupled to the fluid ejection die (100). To eject the fluid, the nozzle (220) includes various components. Specifically, a nozzle (220) includes an ejector (222), an ejection chamber (228), and a nozzle orifice (226). The nozzle orifice (226) may allow fluid, such as ink, to be deposited onto a surface, such as a print medium. The ejection chamber (228) may hold an amount of fluid. The ejector (222) may be a mechanism for ejecting fluid from the ejection chamber (228) through the nozzle orifice (226), where the ejector (222) may include a firing resistor or other thermal device, a piezoelectric element, or other mechanism for ejecting fluid from the ejection chamber (228).

In the case of a thermal inkjet operation, the ejector (222) is a heating element. Upon receiving the firing signal, the heating element initiates heating of the ink within the ejection chamber (228). As the temperature of the fluid in proximity to the heating element increases, the fluid may vaporize and form a drive bubble. As the heating continues, the drive bubble expands and forces the fluid out of the nozzle orifice (226). As the vaporized fluid bubble collapses, a negative pressure within the ejection chamber (228) draws fluid into the ejection chamber (228) from the fluid supply, and the process repeats. This system is referred to as a thermal inkjet system.

FIG. 2B also depicts a drive bubble detection device (224). The drive bubble detection device (224) depicted in FIG. 2B is an example of an actuator sensor (104) depicted in FIG. 2A. Accordingly, as with the actuator sensors, each drive bubble detection device (224) is coupled to a respective actuator (102) of the number of actuators (102) and the drive bubble detection devices (224) are part of a primitive (110) to which the corresponding actuator (102) is a component.

The drive bubble detection device (224) may include an electrically conductive plate, such as a tantalum plate, which can detect impedance of whatever medium is within the ejection chamber (228). Specifically, each drive bubble detection device (224) measures an impedance of the medium within the ejection chamber (228), which impedance measure can indicate whether a drive bubble is present in the ejection chamber (228). The drive bubble detection device (224) then outputs a first voltage value indicative of a state, i.e., drive bubble formed or not, of the corresponding nozzle (220). This output can be compared against a threshold voltage to determine whether the nozzle (220) is malfunctioning or otherwise inoperable.

Returning to FIG. 2A, the system (212) also includes a number of pre-charge devices (218-1, 218-2, 218-3, 218-4). Specifically, the system (212) includes a pre-charge device (218) per primitive (110). That is, each of the pre-charge devices (218-1, 218-2, 218-3, 218-4) may be uniquely paired with a corresponding primitive (110-1, 110-2, 110-3, 110-4). That is a first primitive (110-1) may be uniquely paired with a first pre-charge device (218-1). Similarly, a second primitive (110-2), third primitive (110-3), and a fourth primitive (110-4) may be uniquely paired with a second pre-charge device (218-2), third pre-charge device (218-3), and fourth pre-charge device (218-4), respectively. In one example, each pre-charge device (218) corresponds to just the number of actuators (102) and just the number of actuator sensors (104) within that particular primitive (110).

The pre-charge devices (218) pre-charge a corresponding threshold voltage storage device to a threshold voltage. That is the pre-charge device (218) within a particular primitive (110) may receive a global threshold voltage, which is then passed off, and stored in a threshold voltage storage device for the primitive (110). This may all occur during an electrical quiescent period when the transmission line on which the threshold voltage is passed is less susceptible to electrical interference. Then, at a later point in time, i.e., during the activation of an actuator (102) within the primitive (110), this pre-charged threshold voltage is passed to the actuator evaluation device (108) for evaluation of the actuator (102) under test. Including a pre-charge device (218) enhances the reliability of actuator (102) evaluation. For example, as described above, as the fluid ejection die (100) is relatively small and transmission lines are close together, there is a risk of coupling, i.e., electrical interference, between these transmission lines. This complication is compounded when a line from which the noise originates is frequently used, as are the evaluation pulse transmission lines that generate noise for the threshold voltage transmission lines. Accordingly, by determining a quiescent period, and pre-charging a threshold voltage at this time, the effects of noise on the threshold voltage are minimized, thus increasing the reliability of any subsequent nozzle evaluation.

Returning to FIG. 2A, the system (212) also includes a number of actuator evaluation devices (108-1, 108-2, 108-3, 108-4). Specifically, the system (212) includes an actuator evaluation device (108) per primitive. That is, each of the actuator evaluation devices (108-1, 108-2, 108-3, 108-4) may be uniquely paired with a corresponding primitive (110-1, 110-2, 110-3, 110-4). That is a first primitive (110-1) may be uniquely paired with a first actuator evaluation device (108-1). Similarly, a second primitive (110-2), third primitive (110-3), and a fourth primitive (110-4) may be uniquely paired with a second actuator evaluation device (108-2), third actuator evaluation device (108-3), and fourth actuator evaluation device (108-4), respectively. In one example, each actuator evaluation device (108) corresponds to just the number of actuators (102) and just the number of actuator sensors (104) within that particular primitive (110).

The actuator evaluation devices (108) evaluate a characteristic of the actuators (102) within their corresponding primitive (110) based at least in part on an output of an actuator sensor (104) corresponding to the actuator (102), and a pre-charged threshold voltage from the pre-charge device (218). That is, an actuator evaluation device (108) identifies a malfunctioning actuator (102) within its primitive (110). For example, a threshold voltage may be such that a voltage lower than the threshold would indicate an actuator sensor (104) in contact with fluid and a voltage higher than the threshold voltage would indicate an actuator sensor (104) that is in contact with vapor, i.e., a drive bubble. Accordingly, per this comparison of the pre-charged threshold voltage and the first voltage, it can be determined whether vapor or fluid is in contact with the actuator sensor (104) and accordingly, whether an expected drive bubble has been formed. While one particular relationship, i.e., low voltage indicating fluid and high voltage indicating vapor, has been presented, other relationships could exist, i.e., high voltage indicating fluid and low voltage indicating vapor.

Including the actuator evaluation device (108) on the fluid ejection die (100) improves the efficiency of actuator evaluation. For example, in other systems, any sensing information collected by an actuator sensor (104) is not per actuator (102), nor is it assessed on the fluid ejection die (100), but is rather routed off the fluid ejection die (100) to a printer, which increases communication bandwidth usage between the fluid ejection die (100) and the printer in which it is installed. Moreover such primitive/actuator evaluation device pairing allows for the localized "in primitive" assessment which can be used locally to disable a particular actuator (102), without involving the printer or the rest of the fluid ejection die (100).

Including an actuator evaluation device (108) per primitive (110) increases the efficiency of actuator evaluation. For example, were the actuator evaluation device (108) to be located off die, while one actuator (102) is being tested, all the actuators (102) on the die (100), not just those in the same primitive (110), would be deactivated so as to not interfere with the testing procedure. However, where testing is done at a primitive (110) level, other primitives (110) of actuators (102) can continue to function to eject or move fluid. That is, an actuator (102) corresponding to the first primitive (110-1) may be evaluated while actuators (102) corresponding to the second primitive, (110-2), the third primitive (110-3), and the fourth primitive (110-4) may continue to operate to deposit fluid to form printed marks.

Following this comparison, the actuator evaluation devices (108) may generate an output indicative of a failing actuator of the fluid ejection die (100). This output may be a binary output, which could be used by downstream systems to carry out any number of operations.

Figure 3:
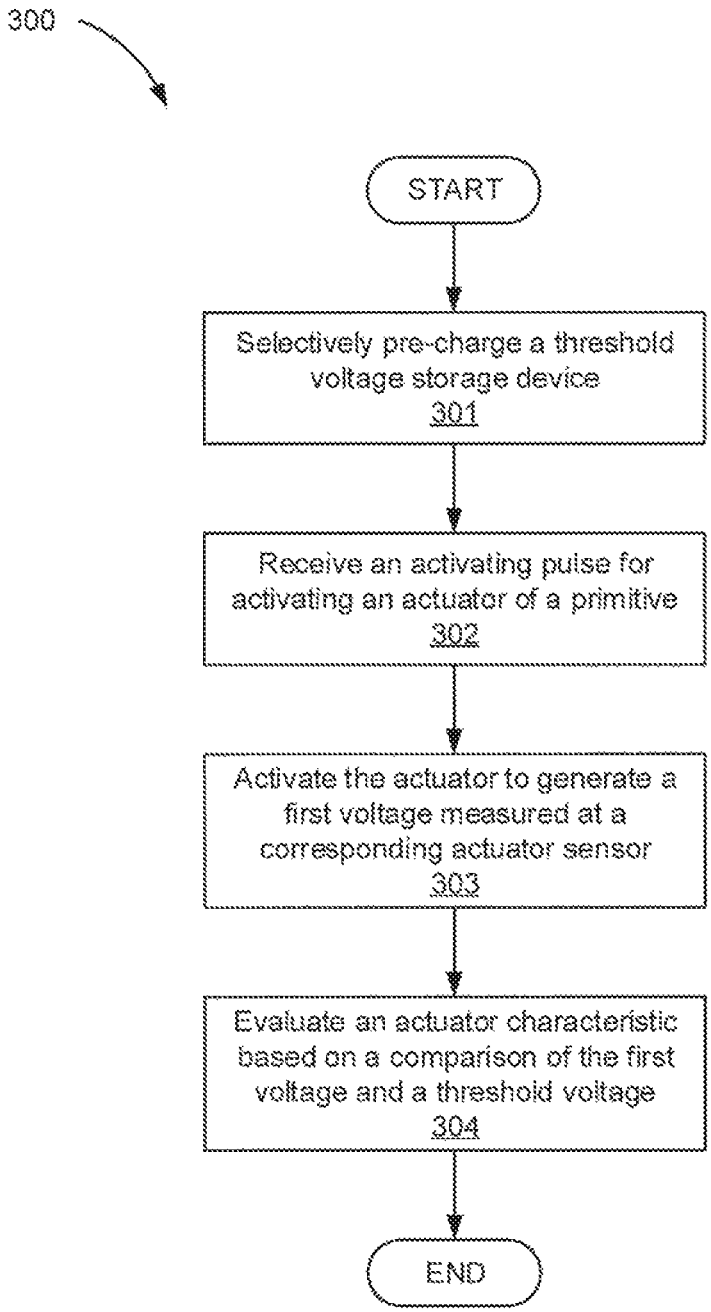
FIG. 3 is a flowchart of a method for performing on-die actuator evaluation using a pre-charged threshold voltage, according to an example of the principles described herein.

FIG. 3 is a flowchart of a method (300) for performing on-die actuator (FIG. 1A, 102) evaluation using a pre-charged threshold voltage, according to an example of the principles described herein. According to the method (300), a threshold voltage storage device is selectively pre-charged (block 301) to a threshold voltage. That is, during a time period expected to have little electrical noise from actuator (FIG. 1A, 102) firing, data clocking or other sources, a global threshold voltage transmission line is active and a voltage passed along this line is stored in a threshold voltage storage device. This time period when this occurs is referred to as an electrically quiescent period. Before the quiescent period is over, the global transmission line is deactivated and the threshold voltage remains in the threshold voltage storage device.

In some examples, the method (300) also includes determining the electrically quiescent time period for the fluid ejection die (FIG. 1A, 100). This electrically quiescent period may correspond to a period of time, on the scale of least microseconds, when there are no, or few, electrical signals being transmitted throughout the fluid ejection die (FIG. 1A, 100). In some examples, the electrically quiescent period may be smaller than microseconds. For example, an electrically quiescent period as short as 50 nanoseconds may be sufficient to pre-charge the threshold voltage. Examples of these time periods include, at the end of a swatch of a fluid ejection device, in between pages of a print job, in between print jobs, and during periods when the entire printer in which the fluid ejection die (FIG. 1A, 100) is installed is inactive.

In some examples, pre-charging (block 301) may include pre-charging multiple threshold storage devices. That is, the global threshold transmission lines may be coupled to multiple primitives (FIG. 1A, 110) and may therefore pass the threshold voltage to multiple pre-charge devices (FIG. 2, 218).

According to the method (300), an activation pulse is received (block 302) at an actuator (FIG. 1A, 102). That is, a controller, or other off-die device, sends an electrical impulse that initiates an activation event. For a non-ejecting actuator, such as a recirculation pump, the activation pulse may activate a component to move fluid throughout the fluid channels and fluid slots within the fluid ejection die (FIG. 1A, 100). In a nozzle, (FIG. 2B, 220), the activation pulse may be a firing pulse that causes the ejector (FIG. 2B, 222) to eject fluid from the ejection chamber (FIG. 2B, 228).

In the specific example of a nozzle, the activation pulse may include a pre-charge pulse that primes the ejector (FIG. 2B, 222). For example, in the case of a thermal ejector, the pre-charge may warm up the heating element such that the fluid inside the ejection chamber (FIG. 2B, 228) is heated to a near-vaporization temperature. After a slight delay, a firing pulse is passed, which heats the heating element further so as to vaporize a portion of the fluid inside the ejection chamber (FIG. 2B, 228). Receiving (block 302) the activation pulse at an actuator (FIG. 1A, 102) to be actuated may include directing a global activation pulse to a particular actuator (FIG. 1A, 102). That is, the fluid ejection die (FIG. 1A, 100) may include an actuator select component that allows the global activation pulse to be passed to a particular actuator for activation. The actuator (FIG. 1A, 102) that is selected is part of a primitive (FIG. 1A, 110). It may be the case, that one actuator (FIG. 1A, 102) per primitive (FIG. 1A, 110) may be activated at any given time.

Accordingly, the selected actuator (FIG. 1A, 102) is activated (block 303) based on the activation pulse. For example, in thermal inkjet printing, the heating element in a thermal ejector (FIG. 2A, 222) is heated so as to generate a drive bubble that forces fluid out the nozzle orifice (FIG. 2B, 226). The firing of a particular nozzle (FIG. 2A, 220) generates a first voltage output by the corresponding actuator sensor (FIG. 1A, 104), which output is indicative of an impedance measure at a particular point in time. That is, each actuator sensor (FIG. 1A, 104) is coupled to, and in some cases, uniquely paired with, an actuator (FIG. 1A, 102). Accordingly, the actuator sensor (FIG. 1A, 104) that is uniquely paired with the actuator (FIG. 1A, 102) that has been fired outputs a first voltage.

To generate the first voltage, a current is passed to an electrically conductive plate of the actuator sensor (FIG. 1A, 104), and from the plate to the fluid or fluid vapor. For example, the actuator sensor (FIG. 1A, 104) may include a tantalum plate disposed between the ejector (FIG. 2B, 222) and the ejection chamber (FIG. 2B, 228). As this current is passed to the actuator sensor (FIG. 1A, 104) plate, and from the plate to the fluid or fluid vapor, an impedance is measured and a first voltage determined.

In some examples, activating (block 303) the actuator (FIG. 1A, 102) to obtain a first voltage for activator evaluation may be carried out during the course of forming a printed mark. That is, the firing event that triggers an actuator evaluation may be a firing event to deposit fluid on a portion of the media intended to receive fluid. In other words, there is no dedicated operation relied on for performing activator evaluation, and there would be no relics of the activator evaluation process as the ink is deposited on a portion of an image that was intended to receive fluid as part of the printing operation.

In another example, the actuator (FIG. 1A, 102) is activated (block 303) in a dedicated event independent of a formation of a printed mark. That is, the event that triggers an actuator evaluation may be in addition to a firing event to deposit fluid on a portion of the media intended to receive fluid. That is the actuator may fire over negative space on a sheet of media, and not one intended to receive ink to form an image.

An actuator characteristic is then evaluated (block 304) based at least in part on a comparison of the first voltage and the pre-charged threshold voltage. In this example, the pre-charged threshold voltage may be selected to clearly indicate a blocked, or otherwise malfunctioning, actuator (FIG. 1A, 102). That is, the pre-charged threshold voltage may correspond to an impedance measurement expected when a drive bubble is present in the ejection chamber (FIG. 2B, 228), i.e., the medium in the ejection chamber (FIG. 2B, 228) at that particular time is fluid vapor. Accordingly, if the medium in the ejection chamber (FIG. 2B, 228) were fluid vapor, then the received first voltage would be comparable to the pro-charged threshold voltage. By comparison, if the medium in the ejection chamber (FIG. 2B, 228) is print fluid such as ink, which may be more conductive than fluid vapor, the impedance would be lower and a lower voltage would be output. Accordingly, the pre-charged threshold voltage is configured such that a voltage lower than the threshold indicates the presence of fluid, and a voltage higher than the threshold indicates the presence of fluid vapor. If the first voltage is thereby greater than the pre-charged threshold voltage, it may be determined that a drive bubble is present and if the first voltage is lower than the pre-charged threshold voltage, it may be determined that a drive bubble is not present when it should be, and a determination made that the nozzle (FIG. 1A, 102) is not performing as expected. While specific reference is made to output a low voltage to indicate low impedance, in another example, a high voltage may be output to indicate low impedance.

In some examples, the pre-charged threshold voltage against which the first voltage is compared depends on an amount of time passed since the activation of the actuator (FIG. 1A, 102). For example, as the drive bubble collapses, the impedance in the ejection chamber (FIG. 2B, 228) changes over time, slowly returning to a value indicating the presence of fluid. Accordingly, the pre-charged threshold voltage against which the first voltage is compared also changes over time.

Figure 4:
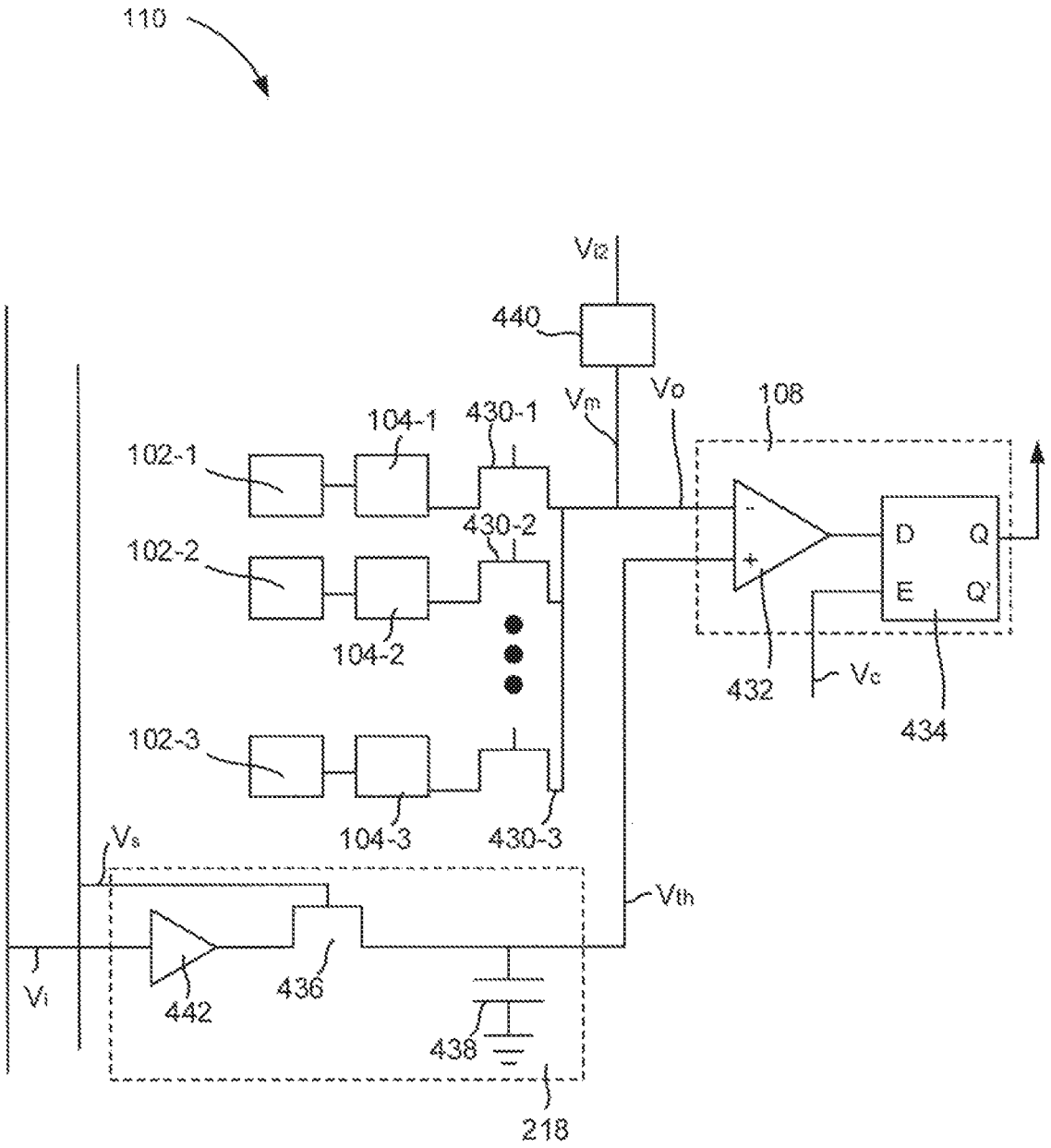
FIG. 4. is a circuit diagram of on-die actuator evaluation components, according to another example of the principles described herein.

FIG. 4. is a circuit diagram of on-die actuator evaluation components, according to another example of the principles described herein. Specifically, FIG. 4 is a circuit diagram of one primitive (110). As described above, the primitive (110) includes a number of actuators (102) and a number of actuator sensors (104) coupled to respective actuators (102). During operation, a particular actuator (102) is selected for activation. While active, the corresponding actuator sensor (104) is coupled to the actuator evaluation device (108) via a selecting transistor (430-1, 430-2, 430-3). That is, selecting transistor (430) forms a connection between the actuator evaluation device (108) and the selected actuator sensor (104). The selecting transistor being actuated also allows a current to pass through to the corresponding actuator sensor (104) such that an impedance measure of the ejection chamber (FIG. 2B, 228) within the actuator (102) can be made.

FIG. 4 also depicts a pre-charge device (218) that outputs a pre-charged threshold voltage, $V_{th}$. As described above, the pre-charge device (218) includes a threshold voltage storage device, which in the example depicted in FIG. 4 is a capacitor (438). The capacitor (438) stores the threshold voltage for a period of time. The pre-charge device (218) also includes a transistor (436) that selectively allows an input voltage to pass to the capacitor (438). In some examples, the pre-charge device (218) includes a buffer (442) to condition the input voltage, $V_i$, which is used to generate the pre-charged threshold voltage, $V_{th}$. More specifically, the buffer (442) scales the input voltage, $V_i$, and isolates the input voltage to generate the threshold voltage, $V_{th}$. Without the buffer (442), the act of connecting the input voltage, $V_i$, to the capacitor (438) has the effect of loading the input transmission line while the input voltage, $V_i$, is charging the capacitor (438). This loading may result in the input voltage becoming corrupted, making any primitive (110) observing it to see a corrupted voltage level, at least for a time. The presence of the buffer (442) alleviate this effect.

The buffer (442) also serves to scale any input voltage, $V_i$, in generating the threshold voltage, $V_{th}$. For example, an input signal may be generated that has a larger range, for example from 0 to 5 V. A larger voltage range reduces the effects of noise. However, for purposes of comparison to an output voltage, $V_o$, of the actuator sensor (104), a smaller rang, for example, 2 to 4 V, may be desirable. The buffer (442) scales the input voltage, $V_i$, accordingly, to be within a desired range.

An example of the operation of a pre-charge device (218) is now provided. In this example, an input voltage, $V_i$, may be applied to any number of primitives (110) on a fluid ejection die (FIG. 1A, 100). Once an electrically quiescent period is determined, a select voltage. $V_s$, is applied to the gate of the transistor (436) which allows the output voltage of the buffer (442) to be stored on the capacitor (438). Then at another period of time, i.e., during activation of the actuator (102) under test, the threshold voltage, $V_{th}$, is passed to the actuator evaluation device (108) for evaluation.

In this example, the actuator evaluation device (108) includes a compare device (432) to compare a voltage output. $V_o$, from one of the number of actuator sensors (104) against the pre-charged threshold voltage, $V_{th}$, to determine when a corresponding actuator (102) is malfunctioning or otherwise inoperable. That is, the compare device (432) determines whether the output of the actuator sensor (104), $V_o$, is greater than or less than the threshold voltage, $V_{th}$. The compare device (432) then outputs a signal indicative of which is greater.

The output of the compare device (432) may then be passed to an evaluation storage device (434) of the actuator evaluation device (108). In one example, the evaluation storage device (434) may be a latch device that stores the output of the compare device (432) and selectively passes the output on. For example, the actuator sensor (104), the compare device (432), and the evaluation storage device (434) may be operating continuously to evaluate actuator characteristics and store a binary value relating to the state of the actuator (102). Then, when a control signal, $V_o$, is passed to enable the evaluation storage device (434), the information stored in the evaluation storage device (434) is passed on as an output from which any number of subsequent operations can be performed.

In some examples, the actuator evaluation device (108) may process multiple instances of a first voltage against multiple values of a threshold to determine whether an actuator is blocked, or otherwise malfunctioning. For example, over multiple activation events, the first voltage may be sampled at different times relative to the activation event, corresponding to different phases of drive bubble formation and collapse. Each time the first voltage is sampled, it might be compared against a different threshold voltage. In this example, the actuator evaluation device (108) could either have unique latches to store the result of each comparison, or a single latch, and if the sensor voltage is ever outside of the expected range (given the time at which it was sampled), that actuator (102) can be identified as defective. In this case, single latch stores a bit which represents "aggregate" actuator status. In the case of multiple storage devices, each may store the evaluation result for a different sample time, and the aggregate collection of those bits can allow for the identification of not only the actuator state, but also the nature of the malfunction. Knowing the nature of the malfunction can inform the system as to the proper response (replace the nozzle, service the nozzle [i.e. multiple spits or pumps], clean the nozzle, etc.).

In some examples, the fluid ejection die (FIG. 1A, 100) also includes a detection pre-charge device (440) to provide a precision current onto the sense node. This precision current is then forced onto the selected actuator sensor (104) via the corresponding transistor (430). Doing so generates an output voltage, $V_o$, which will be compared against the pre-charged threshold voltage, $V_{th}$. This precision current is determined based on a voltage, $V_{i2}$, which is passed to the pre-charge device (440). The same lines that introduce noise to the threshold voltage transmission line also may introduce noise into a transmission line that provides $V_{i2}$ to the pre-charge device (440). Accordingly, a detection pre-charge device (440) receives this input voltage, $V_{i2}$, at an electrically quiescent time to later be forced on the selected actuator sensor (104).

Figure 5:
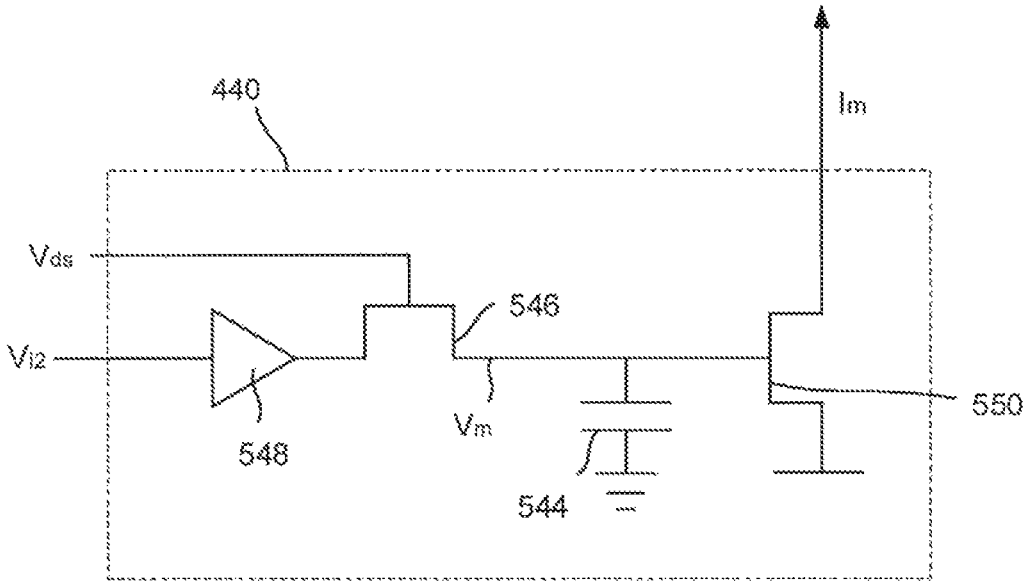
FIG. 5 is a circuit diagram of a sample and hold circuitry depicted in FIG. 4, according to one example of the principles described herein.

FIG. 5 is a circuit diagram of a detection pre-charge device (440) depicted in FIG. 4, according to one example of the principles described herein. Specifically, FIG. 5, depicts the detection pre-charge device (440) being driven by an input voltage, $V_{i2}$, as opposed to an input current. As described above, the input voltage transmission line is subject to noise generated during the operation of the actuators (FIG. 1A, 102) on the fluid ejection die (FIG. 1A, 100). Accordingly, the detection pre-charge device (440) is pre-charged during an electrically quiescent period to avoid the effects of any neighboring noise. An output of the detection pre-charge device (440) is a measurement current, $I_m$, which is used by the actuator sensor (FIG. 1A, 104) in measuring an actuator characteristic.

In generating the measurement current, $I_m$, the detection pre-charge device (440) includes many components. For example, the detection pre-charge device (440) includes a measurement voltage storage device to store a voltage, which in the example depicted in FIG. 5 is a capacitor (544). The capacitor (544) stores the measurement voltage for a period of time. The detection pre-charge device (440) also includes a first transistor (546) that selectively allows a measurement voltage to pass to the capacitor (544). In some examples, the detection pre-charge device (440) includes a buffer (548) to condition an input voltage, $V_{i2}$, which is used to generate the measurement voltage, $V_m$. More specifically, the buffer (548) scales the input voltage, $V_{i2}$, and isolates the input voltage to generate the measurement voltage, $V_m$. The buffer (548) also serves to scale any input voltage, $V_{i2}$, in generating the measurement voltage, $V_m$. For example, an input signal may be generated that has a larger range, for example from 0 to 5 V. A larger voltage range reduces the effects of noise. However, for purposes of comparison to a threshold voltage, $V_{th}$, a smaller range, for example, 2 to 4 V may be desirable. The buffer (548) scales the input voltage, $V_{i2}$, accordingly, to be within a desired range.

The detection pre-charge device (440) also includes a current source including the first transistor (546) as an input selector and a second transistor (550) as an output selector. The output current of the current source is determined by the measurement voltage, $V_m$ that exists between the transistors (546, 550). In effect, the input into the detection pre-charge device (440), i.e., the input voltage, $V_{i2}$, generates a voltage, $V_m$, which generates a corresponding output current, $I_m$, which is scaled relative to the input voltage $V_m$. Such a current source is used to divide down the current at the primitive. Specifically, if a small current used, all primitives (FIG. 1A, 110) on the fluid ejection die (FIG. 1A, 100) would suffer from noise contamination, which could be large. Accordingly, a large current, based on a large $V_{i2}$ is sent, which is more noise immune, and this large value is divided down locally to a current desired via the current mirror of the detection pre-charge device (440).

An example of the operation of a detection pre-charge device (440) is now provided. In this example, an input voltage, $V_{i2}$, may be applied to any number of primitives (110) on a fluid ejection die (FIG. 1A, 100). Once an electrically quiescent period is determined, a detector select voltage, $V_{ds}$, is applied to the gate of the first transistor (546) which allows the output voltage of the buffer (548) to be stored in the capacitor (544), as $V_m$. Then at another period of time, i.e., during activation of the actuator sensor (104) by another transistor (FIG. 4, 430), the measurement current, $I_m$, is passed to the actuator sensor (FIG. 1A, 104) such that an impedance measure can be taken, and a sense voltage passed to an actuator evaluation device (108) for evaluation.

Figure 6:
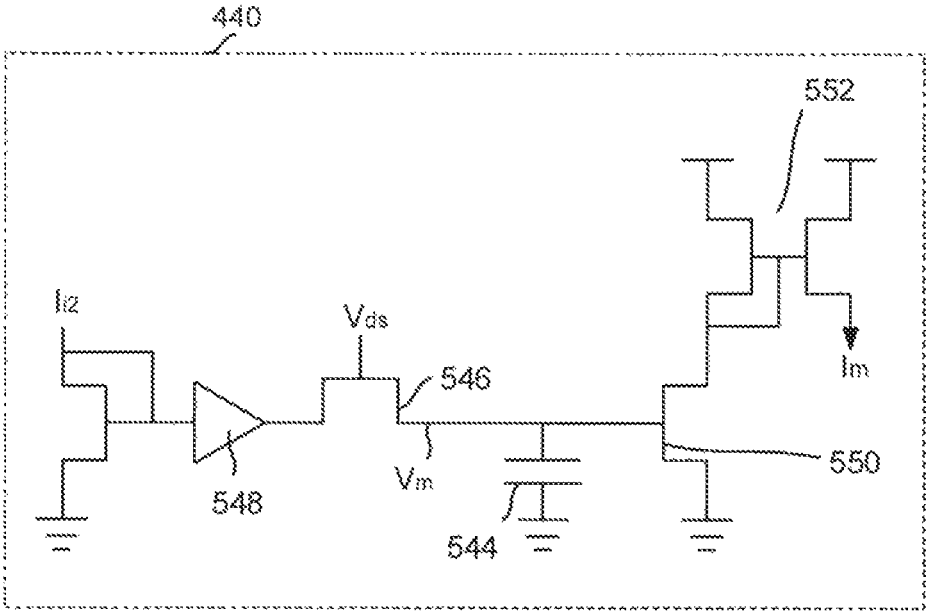
FIG. 6 is a circuit diagram of a sample and hold circuitry depicted in FIG. 4, according to another example of the principles described herein.

FIG. 6 is a circuit diagram of a detection pre-charge device (440) depicted in FIG. 4, according to another example of the principles described herein. Specifically, FIG. 6, depicts the detection pre-charge device (440) being driven by an input current, $I_{i2}$, as opposed to an input voltage. In this example, because a single global input current, $I_{i2}$, is used, each primitive (FIG. 1A, 110) detection pre-charge device (400) is pre-charged one at a time during a pre-charge phase, i.e., that is electrically quiescent, prior to the sending of any activation pulse to that primitive (FIG. 1A, 110). Note also that in this example, a buffer (FIG. 5, 548) may be avoided.

As described above, the input voltage transmission line is subject to noise generated during the operation of the actuators (FIG. 1A, 102) on the fluid ejection die (FIG. 1A, 100). Accordingly, the detection pre-charge device (440) is pre-charged during an electrically quiescent period to avoid the effects of any neighboring noise. An output of the detection pre-charge device (440) is a measurement current, $I_m$, which is used by the actuator sensor (FIG. 1A, 104) in measuring an actuator characteristic.

In generating the measurement current, $I_m$, the detection pre-charge device (440) includes many components. For example, the detection pre-charge device (440) includes a measurement voltage storage device to store a voltage, which in the example depicted in FIG. 5 is a capacitor (544). The capacitor (544) stores the measurement voltage for a period of time. The detection pre-charge device (440) also includes a first transistor (546) that selectively allows the input current, $I_i$, measurement voltage to pass to the capacitor (544) as a voltage, $V_m$.

In operation, an input current, $I_{i2}$, is received and converted into a voltage. Once an electrically quiescent period is determined, a detector select voltage, $V_{ds}$, is applied to the gate of the first transistor (546) which allows the output voltage of the buffer (548) to be stored in the capacitor (544), as $V_m$. Then at another period of time, i.e., during activation of the actuator sensor (104) by another transistor (FIG. 4, 430), this voltage is used to generate an output current, $I_m$, which is passed to the actuator sensor (FIG. 1A, 104) such that an impedance measure can be taken, and a sense voltage passed to an actuator evaluation device (108) for evaluation.

The detection pre-charge device (440) also includes multiple current mirrors as shown (552, and formed by 546, 550). The output current of the current mirrors are determined by the measurement voltage that exists between the transistors In effect, the input into the detection pre-charge device (440), i.e., the input current, $I_i$, generates a voltage, $V_m$, which generates a corresponding output current, $I_m$, that is scaled relative to the transistors in the current mirrors (552 and formed by 546, 550).

In summary, using such a fluid ejection die 1) allows for nozzle evaluation circuitry to be disposed on the die itself, as opposed to sending sensed signals to nozzle evaluation circuitry off die; 2) increases the efficiency of bandwidth usage between the device and die; 3) reduces computation overhead for the device in which the fluid ejection die is disposed; 4) provides improved resolution times for malfunctioning nozzles; 5) allows for actuator evaluation in one primitive while allowing continued operation of actuators in another primitive; 6) places management of nozzles on the fluid ejection die as opposed to on the printer in which the fluid ejection die is installed; and 7) improves the accuracy of actuator evaluation by accounting for the effects of noise on the signals. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection die comprising:

a number of actuator sensors disposed on the fluid ejection die to sense a characteristic of a corresponding actuator and output a first voltage corresponding to the sensed characteristic, wherein:

each actuator sensor is coupled to a respective actuator; and multiple coupled actuator sensors and actuators are grouped as primitives on the fluid ejection die;

a pre-charge device per primitive to pre-charge a corresponding threshold voltage storage device to a threshold voltage; and an actuator evaluation device per primitive to evaluate an actuator characteristic of any actuator within the primitive based on the first voltage and a pre-charged threshold voltage.

2. The fluid ejection die of claim 1, wherein the actuator evaluation device comprises:

a compare device to compare the first voltage against the pre-charged threshold voltage to determine a corresponding actuator state; and an evaluation storage device to:

store an output of the compare device; and selectively pass the stored output as indicated by a control signal.

3. The fluid ejection die of claim 1, wherein:

the threshold voltage storage device comprises a capacitor; and the pre-charge device further comprises a transistor that selectively allows a threshold voltage to pass to the capacitor.

4. The fluid ejection die of claim 1, wherein the pre-charge device further comprises a buffer to condition an input voltage used to generate the threshold voltage that is stored in the threshold voltage storage device.

5. The fluid ejection die of claim 4, wherein the buffer scales the input voltage and isolates the input voltage to generate the threshold voltage.

6. The fluid ejection die of claim 1, further comprising:

a detection pre-charge device to pre-charge the actuator sensor to a predetermined current, the detection pre-charge device comprising:

a detection voltage storage device to store a voltage; and a detection pre-charge device to pre-charge the detection voltage storage device to a detection voltage.

7. The fluid ejection die of claim 6, wherein the detection pre-charge device further comprises:

a current-to-voltage converter to convert an input current into an input voltage;

a buffer to condition the input voltage;

a voltage-to current converter to convert the conditioned input voltage into a detection current; and a current mirror to scale the detection current based on the conditioned input voltage.

8. The fluid ejection die of claim 6, wherein:

the detection voltage storage device comprises a capacitor; and the detection pre-charge device comprises a transistor that selectively allows a voltage to pass to the capacitor.

9. The fluid ejection system of claim 6, wherein the detection pre-charge device further comprises a buffer to condition the detection voltage stored in the detection voltage storage device.

10. The fluid ejection die of claim 1, wherein a single actuator evaluation device and a single pre-charge device are uniquely paired with the actuators of a primitive.

11. A fluid ejection system comprising:

multiple fluid ejection dies, wherein a fluid ejection die comprises:

a number of drive bubble detection devices to output a first voltage indicative of a state of a corresponding actuator, wherein:

each drive bubble detection device is coupled to a respective actuator; and multiple coupled drive bubble detection devices and actuators are grouped as primitives on the fluid ejection die;

a pre-charge device per primitive to pre-charge a corresponding threshold voltage storage device to a threshold voltage; and an actuator evaluation device per primitive to evaluate an actuator characteristic of the actuator based at least in part on a comparison of the first voltage and a threshold voltage.

12. The fluid ejection system of claim 11, wherein:

the threshold voltage storage device comprises a capacitor;

the pre-charge device further comprises a transistor that selectively allows a threshold voltage to pass to the capacitor; and the pre-charge device further comprises a buffer to condition an input voltage used to generate the threshold voltage that is stored in the threshold voltage storage device.

13. A method comprising:

selectively pre-charging a threshold voltage storage device to a threshold voltage;

receiving an activation pulse for activating an actuator of a primitive on a fluid ejection die;

activating the actuator based on the activation pulse to generate a first voltage measured at a corresponding actuator sensor, wherein the corresponding actuator sensor:

is disposed on the fluid ejection die; and is coupled to the actuator; and evaluating an actuator characteristic of the actuator based at least in part on a comparison of the first voltage and a pre-charged threshold voltage.

14. The method of claim 13:

further comprising determining an electrically quiescent period for the fluid ejection die; and wherein selectively pre-charging the threshold voltage storage device to the threshold voltage occurs during the electrically quiescent period.

15. The method of claim 13, further comprising pre-charging multiple threshold voltage storage devices and multiple detection voltage storage devices to simultaneously evaluate multiple actuators in different primitives.

* * * * *